United States Patent [19]

Dietze

[11] 3,990,801

[45] Nov. 9, 1976

[54] CAP FOR A WRITING INSTRUMENT

[75] Inventor: Karl Heinz Otto Dietze, St. Jorioz, France

[73] Assignee: S.T. Dupont, Paris, France

[22] Filed: Aug. 18, 1975

[21] Appl. No.: 605,734

[30] Foreign Application Priority Data

Aug. 20, 1974 France ..... 74.28583

[52] U.S. Cl. ..... 401/243

[51] Int. Cl.[2] ..... B43K 9/00

[58] Field of Search ..... 401/243–247, 401/213, 202, 262

[56] References Cited

UNITED STATES PATENTS 962,053 6/1910 Von Rottenburg ..... 401/247

FOREIGN PATENTS OR APPLICATIONS 944,423 11/1948 France ..... 401/243

1,051,115 12/1966 United Kingdom ..... 401/245

*Primary Examiner*—Lawrence Charles

*Attorney, Agent, or Firm*—Richard A. Wise; Oistein J. Bratlie; Donald E. Mahoney

[57] ABSTRACT

A cap for a writing instrument includes sleeve means coaxially disposed within the cap body and formed from material softer than the material of the writing instrument body. The sleeve means has a non-deformable part and a deformable part arranged to substantially inhibit translational movement of the cap while attached to the writing instrument body. However, the cap may be angularly adjusted without scoring the writing instrument body.

7 Claims, 2 Drawing Figures

CAP FOR A WRITING INSTRUMENT

BACKGROUND OF THE INVENTION

1. Field of the Invention

This invention relates to a cap adapted to be attached to a writing instrument body, and more particularly, to a cap having an internally disposed sleeve with a deformable part and a non-deformable part.

2. Description of the Prior Art

The nib of a writing instrument, such as a pen, is usually protected by a removable pen cap. Pen caps are normally positioned on the back portion of a pen body, away from the nib, when the pen is in the writing position. Prior art pen caps have unavoidably marred or scored the surface of the back portion of the pen body if an attempt is made to rotate the cap while it is attached to the back portion of the pen body. Accordingly, it is desired to provide a pen cap including apparatus arranged to avoid the aforementioned scoring of the back pen body while permitting a rotational or angular adjustment of the pen cap without the necessity of removing the pen cap from the pen body.

SUMMARY OF THE INVENTION

A cap adapted to be attached to a writing instrument body comprises a cap body having sleeve means coaxially disposed within the cap body and coupling means for joining the cap body to the sleeve means to permit the cap body to freely rotate about the sleeve means.

The present invention and advantages thereof will be best understood upon reading the following description in conjunction with the accompanying drawings wherein:

DESCRIPTION OF THE PREFERRED EMBODIMENT

A cap for a writing instrument, such as a pen, is arranged according to the invention, to have an internally disposed tubular sleeve formed from material softer than the material of the pen. The sleeve is encircled by an annular boss or protuberance and the cap has an internal wall with an annular groove. The sleeve is attached to the cap by disposing the annular boss or ring within the groove in the cap wall. The groove and boss are dimensioned to permit the cap to freely rotate about the sleeve while substantially inhibiting translational movement of the cap relative to the sleeve. The sleeve has an internal surface suitably shaped to nearly conform to the shape of an external surface of the pen body so that the pen body may be wedged within the sleeve. As will be further described, the sleeve is arranged to effectively attach the cap to the pen body while writing and to protect a pen nib when the pen is not in use. In addition, when the cap is attached to the pen body while writing, the cap may be angularly adjusted without rubbing and scoring the pen body.

The pen body may be formed to have a top portion for holding the pen nib and a bottom pen portion. The top and bottom pen portions may have slightly different shapes. The sleeve may be coaxially disposed within the cap and include a deformable sleeve portion and a non-deformable sleeve portion. As described below, the bottom portion of the pen body may be wedged in a non-deformable portion of the sleeve to prevent translational movement of the cap relative to the pen body without deforming the deformable portion of the sleeve so as to permit an angular adjustment of the cap to a more comfortable writing position. The top portion of the pen body may be wedged in the deformable portion of the sleeve to protect the pen nib and to prevent translational movement of the cap relative to the pen body and simultaneously deform the deformable portion of the sleeve to prevent angular rotation of the cap.

Figure 1:
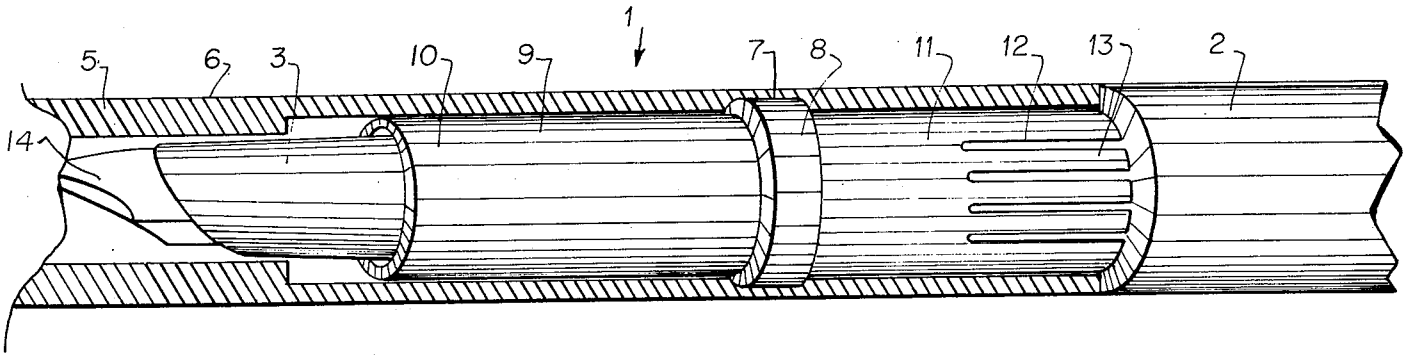
FIG. 1 is a perspective view, partially in section, of a removable pen cap attached to a front portion of a pen body to protect a pen nib.
Figure 2:
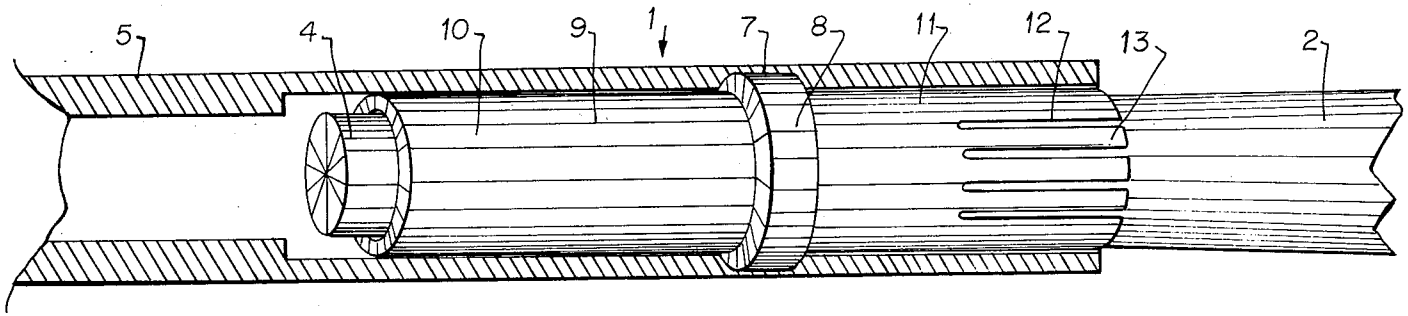
FIG. 2 is a perspective view, partially in section, of a removable pen cap attached to a back portion of a pen body.

Referring to FIGS. 1 and 2, there is shown a writing instrument such as a fountain pen 1 consisting of a body 2 including a nib holder top portion 3 (FIG. 1) and a bottom portion 4 (FIG. 2). The body 2 has an approximate truncated biconical form with a top portion 3 slightly smaller than the bottom portion 4. A removable cap 5 may be attached to the fountain pen, as shown in FIG. 1, to protect a fountain pen nib 14. Similar to other prior art caps, the removable cap 5 has a tubular body 6 with a clip, not shown, at one end. The clip is suitable for coupling the pen cap 5 to a pocket of a user. The body 6 has an internal cylindrical surface including an annular groove 7. An annular ring or protuberance 8 encircles a sleeve 9 coaxially displaced within the body 6 so that the protuberance 8 is disposed within the groove 7. The dimensions of the protuberance 8 and the groove 7 are selected so that when the sleeve 9 is attached to the body 6, the body 6 may rotate about its longitudinal axis.

The sleeve 9 is formed from material softer than the material of the pen body 2 and includes an non-deformable sleeve part 10 on one side of the protuberance 8 and a deformable sleeve part 11 on the other side of protuberance 8. The non-deformable sleeve part 10 is intended to provide a secure attachment of the cap 5 to the body 2 of the fountain pen 1, while in use, by wedging the bottom 4 within non-deformable sleeve part 10 without interfering with rotational movement of the cap 5 relative to the body 2, as shown in FIG. 2. The deformable sleeve part 11 includes axial slots 12 forming elastic fingers 13 intended to provide a secure attachment of the cap 5 to the pen top 3 by wedging the pen top 3 within the deformable sleeve part 11, as shown in FIG. 1. When the pen top 3 is disposed within the deformable sleeve part 11, the elastic fingers 13 are arranged to spread apart against the internal surface of the cap body 6. Thus, the cap 5 is prevented from having translational and rotational movement when attached to the pen top 3. However, referring to FIG. 2, the fingers 13 are not spread apart since the pen bottom 4 is dimensioned to become wedged within the non-deformable sleeve part 10 without deforming sleeve part 11. Consequently, the cap 5 is inhibited from having translational movement but is free to rotate about its longitudinal axis when attached to the pen bottom 4. Thus, the cap 5 may be angularly adjusted to provide a more comfortable writing position without scoring the pen bottom 4 or requiring removal.

In order to facilitate the attachment of the cap 5 to the pen body 2 by wedging the pen top 3 or the pen bottom 4 within the sleeve 9, the sleeve 9 is arranged to have a biconical form. For example, the deformable sleeve part 11 may have a concical form substantially complementing the truncated conical form of the external surface of the pen top 3 and the non-deformable sleeve part 10 may have a conical form substantially complementing the truncated conical form of the external surface of the pen bottom 4.

A preferred embodiment of the invention has been shown and described. Various other embodiments and modifications therefor will be apparent to those skilled in the art. For example, the sleeve 9 may be arranged so that the cap 5 may be attached to the pen top 3 by wedging the pen top 3 in the non-deformable sleeve part 10 without spreading the elastic fingers 13 apart to permit the cap 5 to angularly rotate about pen body 2 while protecting the pen nib 14. It is also apparent that the cap 5 may be attached to the pen bottom 4 by wedging the pen bottom 4 within the deformable sleeve part 11 to spread the elastic fingers 13 apart and thereby wedging the deformable sleeve part 11 against the internal surface of the cap body 6 to prevent translational and rotational movement of the cap 5.

What is claimed as new and desired to be secured by Letters Patent of the United States is:

1. A cap adapted to be attached to a writing instrument body, comprising:

a cap body;

sleeve means coaxially disposed with the said cap body; and coupling means for joining said cap body to said sleeve means to permit said cap body to freely rotate about said sleeve means.

2. A writing instrument cap according to claim 1, wherein said coupling means includes a protuberance cooperating with an annular groove.

3. A writing instrument cap according to claim 2, wherein said protuberance include a ring encircling said sleeve means and said annular groove being formed on said cap.

4. A writing instrument cap according to claim 3, wherein said sleeve means includes a substantially non-deformable part in which said writing instrument body is wedged to substantially inhibit both translational and angular movement of said sleeve means relative to said writing instrument body.

5. A writing instrument cap according to claim 4, wherein said sleeve means has a substantially elastically deformable part in which said writing instrument is wedged to substantially inhibit both translational and angular movement of said sleeve means relative to said writing instrument body.

6. A writing instrument cap according to claim 5, wherein said elastically deformable part of said sleeve means has a plurality of axial slots.

7. A writing instrument cap according to claim 1, wherein said writing instrument body has first truncated conical shaped end and second truncated shaped end, and said sleeve means having a deformable part substantially complementing said first end of said body and a non-deformable part substantially complementing said second end of said body.

* * * * *